US006544065B1

(12) United States Patent
Howell et al.

(10) Patent No.: US 6,544,065 B1
(45) Date of Patent: Apr. 8, 2003

(54) ZIF SOCKET CONNECTOR

(75) Inventors: David Gregory Howell, Gilbert, AZ (US); Yao-Chi Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/161,882

(22) Filed: Jun. 3, 2002

(51) Int. Cl.[7] ..... H01R 4/50
(52) U.S. Cl. ..... 439/342
(58) Field of Search ..... 439/342, 259–270

(56) References Cited

U.S. PATENT DOCUMENTS 5,454,727 A * 10/1995 Hsu ..... 439/342 X
5,489,218 A 2/1996 McHugh
6,280,223 B1 8/2001 Lin
6,338,639 B1 1/2002 Trout et al.
6,371,785 B1 * 4/2002 Howell et al. ..... 439/342

OTHER PUBLICATIONS

"ZIF PGA Socket", "Connector Specifier", Feb. 1995, p. 2.
"PGA Socket" and "ZIF PGA Socket", "Connector Specifier", Feb. 1995, p. 3.
"ZIF PGA Socket 3, 5, 7, 8", "Connector Specifier", May 1998, p. 5.
Kevin Alberts, "ZIF PGA Socket" and "BGA Socket", Nov. 1998, p. 35.

* cited by examiner

*Primary Examiner*—Lynn Field
*Assistant Examiner*—Son V. Nguyen
(74) *Attorney, Agent, or Firm*—Wei Te Chung

(57) ABSTRACT

An electrical socket for supporting an integrated circuit chip on a circuit board mainly includes a dielectric base, a number of conductive contacts retained in the base, a cover and an actuation member for movably attaching to the cover with respect to the base. The actuation member includes a cam shaft whose one end has a step-shaped face and forms an upper portion and a lower portion. The base defines a receiving hole for receiving the end of the cam shaft. The receiving hole has a step-shaped mating face forming an upper portion and a lower portion.

7 Claims, 5 Drawing Sheets

ZIF SOCKET CONNECTOR

BACKGROUND OF THE INVENTION

1. Field of the Invention

The present invention is related to an electrical socket connector, and more particularly to a zero insertion force (ZIF) socket for electrically assembling an integrated circuit chip to a printed circuit board (PCB), wherein the ZIF socket has an actuation member for motivating a cover relative to a base of the ZIF socket.

2. Description of Related Art

Conventional ZIF sockets normally comprise a cover defining a plurality of upper passageways therein and slidably engaging with a base having a corresponding number of lower passageways retaining contacts therein. Optionally, the cover is driven to move with respect to the base by a screwdriver. U.S. Pat. Nos. 5,730,615 and 6,347,951 disclose such a driving mechanism for driving the cover to move on the base by inserting a screwdriver into slots defined in the cover and the base and pivoting the screwdriver to drive the cover to move. Such operation of the screwdriver is inconvenient. Furthermore, the screwdriver which is made of hard material (usually steel) can cause damage to either the cover or the base which is made of relatively soft material (usually plastics) when the screwdriver is used to drive the cover to move relative to the base.

In order to prevent the above-mentioned shortcoming, another ZIF socket having an actuation device for moving the cover attached with a CPU component relative to the base is provided. For instance, U.S. Pat. Nos. 4,498,725, 5,489,218 and 5,454,727, as well as page 35, page 5 and pages 2~3 of periodical entitled "CONNECTOR SPECIFIER" published respectively on November 1998, May 1998 and February 1995 all disclose such a typical ZIF socket including an actuation device. The actuation device consists of an exposed lever and an embedded rotation bar wherein the rotation bar joins the lever at one end and the bar further includes multiple cam sections or crank shaft sections. When the bar is oriented vertically to the base, the pins of the CPU component can be freely inserted into the socket. Successively, the operator manually pushes the lever downward to a horizontal position, during which the cam sections or the crank shaft sections of the rotation bar move the cover together with the CPU component horizontally and the pins of the CPU component are moved to engage with the corresponding contacts of the socket. Reversely, when the lever is moved from the horizontal position back to the vertical position, the cover together with the CPU component is moved horizontally in a reverse direction. Therefore, the engagement between the contacts of the socket and the pins of the CPU component is released, and the CPU component can be detached from the socket. Above-mentioned socket uses an actuation lever located along one side of the socket. However, the actuation lever increases the width of the socket. This is unfavorable in view of the minimization and compact trend of electronic components.

U.S. Pat. No. 6,338,639 discloses a socket having an actuation member configured to move a cover when the actuation member is rotated about a rotational axis. The actuation member is so designed that the rotational axis of the actuation member is parallel to the longitudinal sides of the socket along which the cover is moved relative to the base. The actuation member includes a cam assembly and an actuation lever. The actuation lever includes a handle and a leg. The actuation member is complicated in structure, which is disadvantageous from a cost consideration.

U.S. Pat. No. 6,280,223 discloses another socket having a simple driving mechanism. Nevertheless, when the socket is at a closed position, a high stress exists between the cam and a cover plate of the cover. The cam is made of zinc alloy. When the socket is exposed to an elevated temperature due to the operation of the CPU component mounted on the cover, the high stress causes the cam to creep because of the poor creep strength of zinc alloy. The creep of the cam causes the cam to deform from its original configuration whereby the cam can no longer achieve its requested stroke when it is rotated to move the cover relative to the base. Accordingly, the pins of the CPU component can not be moved to correctly engage with the contacts at the closed position or totally disengage from the contacts at the open position of the socket.

Hence, it is requisite to provide an electrical socket with an improved driving mechanism to overcome the above-mentioned disadvantages.

SUMMARY OF THE INVENTION

Accordingly, a first object of the present invention is to provide an electrical socket having an improved actuation member which can provide a effective stroke for the socket to ensure a reliable connection between the pins of an integrated circuit chip and conductive contacts of the socket.

A second object of the present invention is to provide an improved actuation member for a ZIF socket wherein the actuation member is convenient to manipulate by a user without increasing the width of the socket.

A third object of the present invention is to provide an improved actuation member for a ZIF socket which has a simple structure, thereby reducing cost.

In order to achieve the objective set forth, a electrical socket in accordance with the present invention is adapted for supporting an integrated circuit chip on a circuit board. The socket comprises a dielectric base defining an array of terminal cells, a plurality of conductive contacts received in the terminal cells, a cover slidably mounted on the base and an actuation member for moving the cover with respect to the base. The base defines a receiving space in one side thereof for receiving the actuation member and a receiving hole formed in an inner face of a lateral side portion thereof and communicating with the receiving space. The receiving space includes a receiving chamber and a receiving slot. The receiving hole has a step-shaped mating face forming an upper portion and a lower portion. The actuation member includes an operating handle and a cam shaft having a stepped shape and forming a cam member for moving the cover with respect to the base. The cam shaft has a contacting end for interacting with the mating face. The contacting end has a stepped shape and forms an upper portion and a lower portion. When the socket is at an open position, the upper portion of the contacting end of the cam shaft bears against the upper portion of the mating face of the receiving hole. When the socket is at a closed position, the upper and lower position of the contacting end of the cam shaft bear against the lower and upper portion of the mating face of the receiving hole, respectively.

Other objects, advantages and novel features of the invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
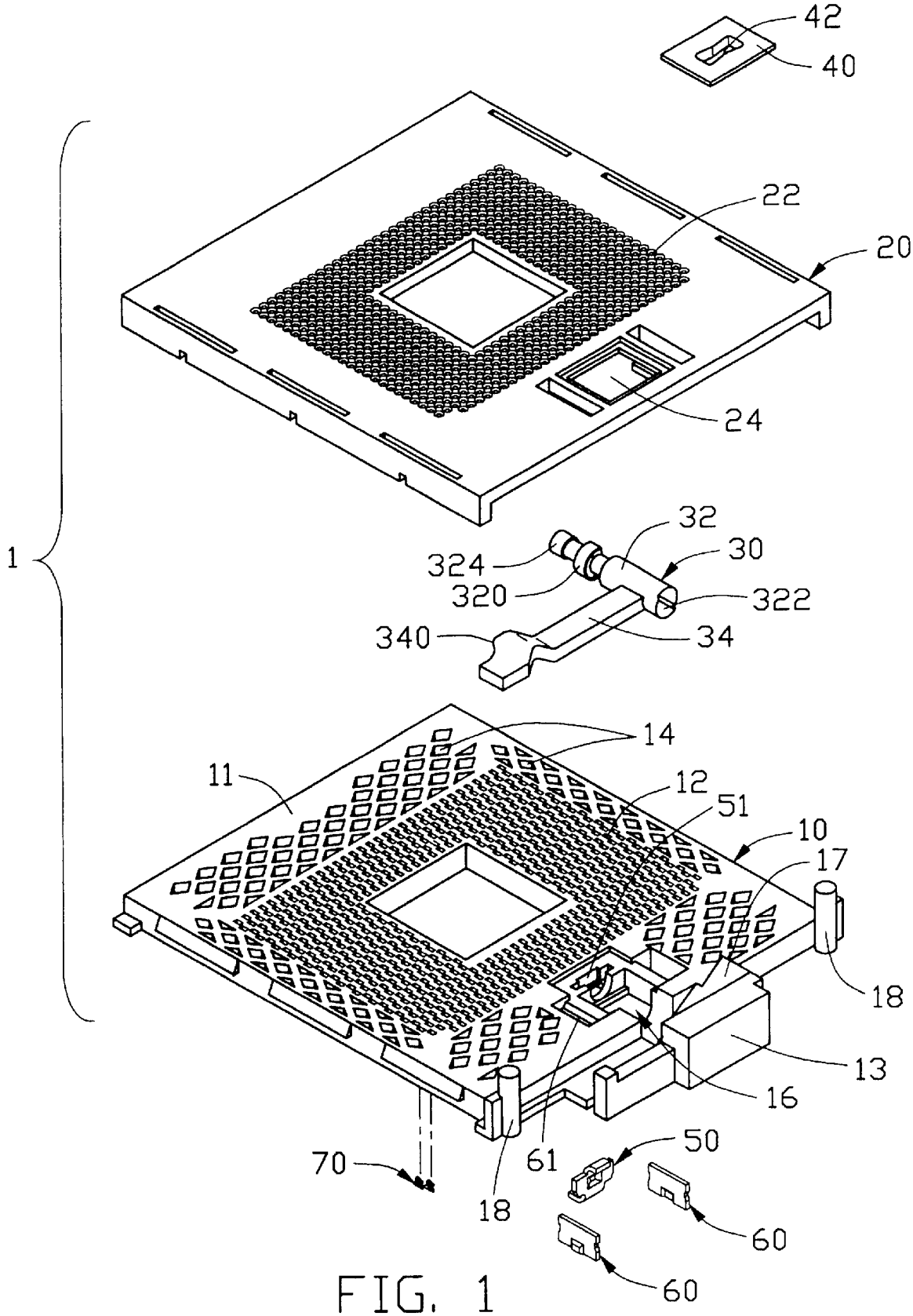
FIG. 1 is an exploded perspective view of an electrical socket in accordance with the present invention.

Referring to FIG. 1 first, a CPU socket 1, particularly a ZIF BGA socket, for electrically assembling a CPU package (not shown) to a printed circuit board (not shown) in accordance with the present invention comprises a dielectric base 10 adapted for being securely mounted onto the printed circuit board, a plurality of conductive contacts 70 retained in the base 10, a cover 20 movably covered on the base 10 and an actuation member 30 assembled between the base 10 and the cover 20.

Figure 3:
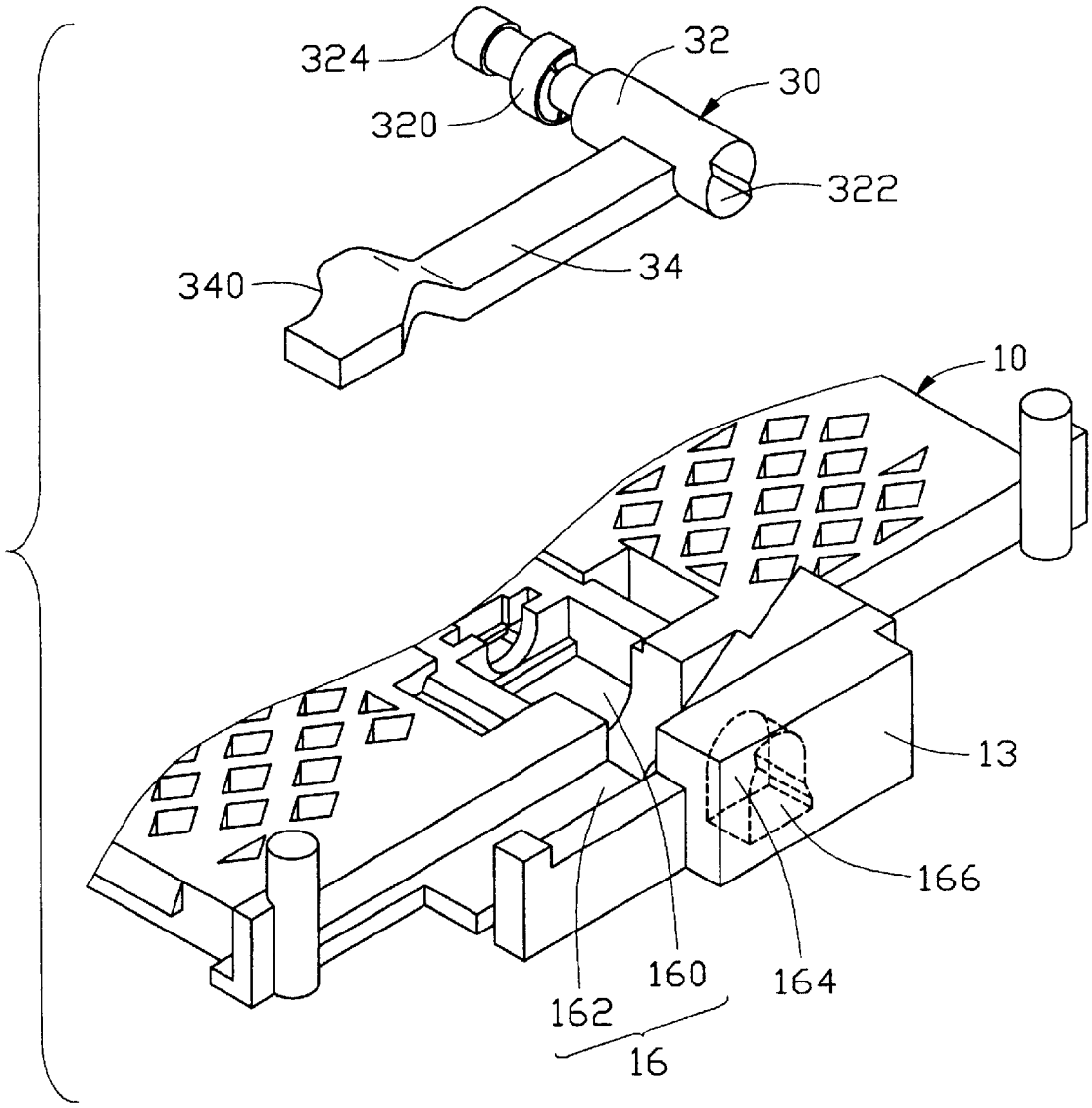
FIG. 3 is an enlarged perspective view of a section of a dielectric base and an actuation member of the electrical socket of FIG. 1 before assembly.

Referring to FIGS. 1 and 3, the dielectric base 10 defines an array of terminal cells 12 for receiving a corresponding number of the conductive contacts 70, and an array of through holes 14 around the terminal cells 12. The holes 14 are devised for an optimal formation of the base 10 by plastics injection molding. A receiving space 16 is defined in a top face 11 of the base 10 for receiving the actuation member 30. The receiving space 16 includes a receiving chamber 160 among the through holes 14 and a receiving slot 162 extending along a lateral side portion 13 of the base 10 and communicating with the receiving chamber 160. A receiving hole 164 is defined in an inner face of the lateral side portion 13 and in alignment with the receiving chamber 160. The receiving hole 164 has a step-shaped mating face 166 (see FIGS. 4 and 5) having an upper portion 1660, a lower portion 1662 and a slope portion 1664 between the upper and lower portions 1660, 1662. Additionally, the lateral side portion 13 of the base 10 forms an inclined face 17 in the receiving slot 162 for preventing the actuation member 30 from over-rotating. A pair of stopping posts 18 is further formed at opposite ends of the lateral side portion 13.

Referring to FIG. 1 again, the cover 20 defines an array of pin holes 22 vertically corresponding to the terminal cells 12 of the base 10 for insertion of pins of the CPU package (not shown) therethrough. A through aperture 24 is defined in a side of the cover 30 corresponding to the receiving chamber 160 of the base 10.

Referring to FIG. 3, the actuation member 30 includes a cam shaft 32 and an operating handle 34 perpendicularly extending from the cam shaft 32 for respectively inserting into the receiving chamber 160 and the receiving slot 162 of the base 10. The cam shaft 32 has a cam member 320 for driving the cover 20 to move with respect to the base 10, a supported end 324 remote from the operation handle and for being rotatably supported on the base 10 and a contacting end 322 opposite the supported end 324 and for having an interaction with the mating face 166 as will be detailed below. The contacting end 322 (see FIGS. 4 and 5) includes an upper portion 3220, a lower portion 3222 and a slope portion 3224 between the upper and lower portions 3220, 3222. So the contacting end 322 has a stepped shape and is received in the receiving hole 164 to interact with the mating face 166 thereof. The operating handle 34 has a curved portion 340 to engage with the post 18 of the base 10 to retain the actuation member 30 at a closed position.

Referring to FIG. 1 again, several components of the socket 1 are shown, such as a cover plate 40, a shaft clip 50 and a pair of latching plates 60. The cover plate 40, made of metal, is fixed to the through aperture 24 of the cover 20 by insert molding. An opening 42 is defined in the cover plate 40 for insertion of the cam member 320 of the actuation member 30 therein. The shaft clip 50 is inserted into a corresponding receiving slit 51 of the base 10 and abuts against the supported end 324 of the cam shaft 32 for fixing the actuation member 30 in position. The pair of latch plates 60 is upwardly inserted into through slots 61 of the base 10 and beside hooks (not shown) on a bottom of the cover 20 for preventing the cover 20 from separating from the base 10.

Figure 2:
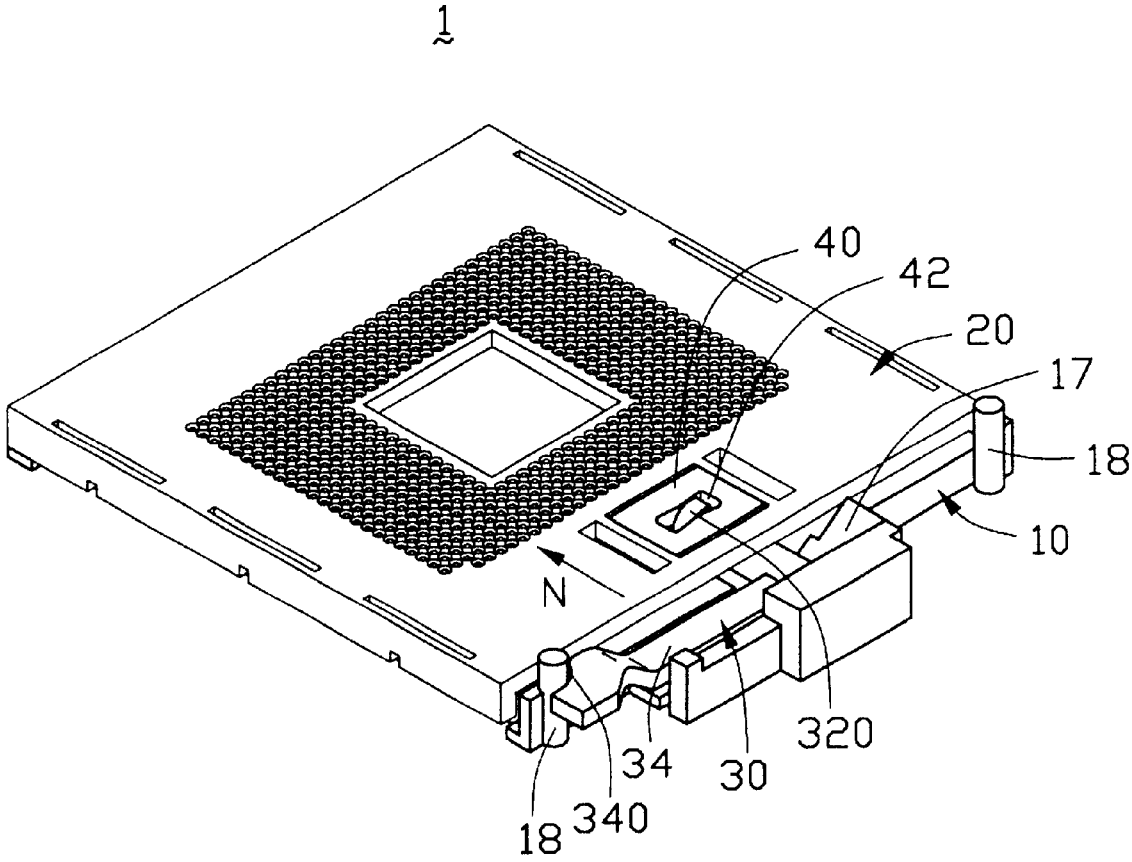
FIG. 2 is an assembled view of FIG. 1.
Figure 4:
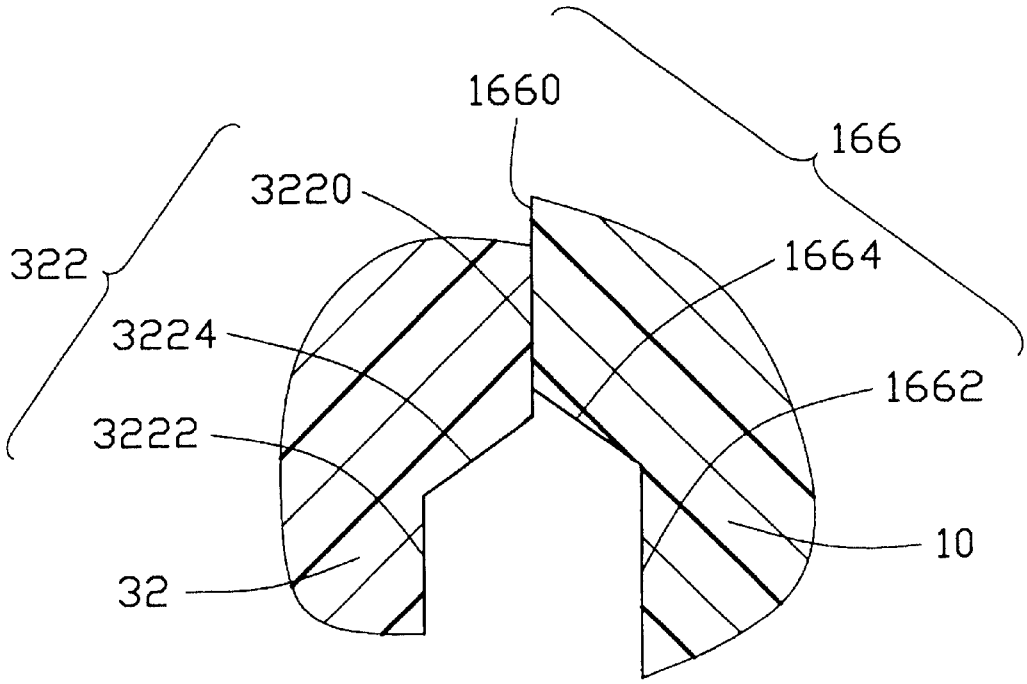
FIG. 4 is an enlarged cross-sectional view of an end section of the actuation member and a portion of the dielectric base bearing against the end section of the actuation member when the electrical socket is at an open position.
Figure 5:
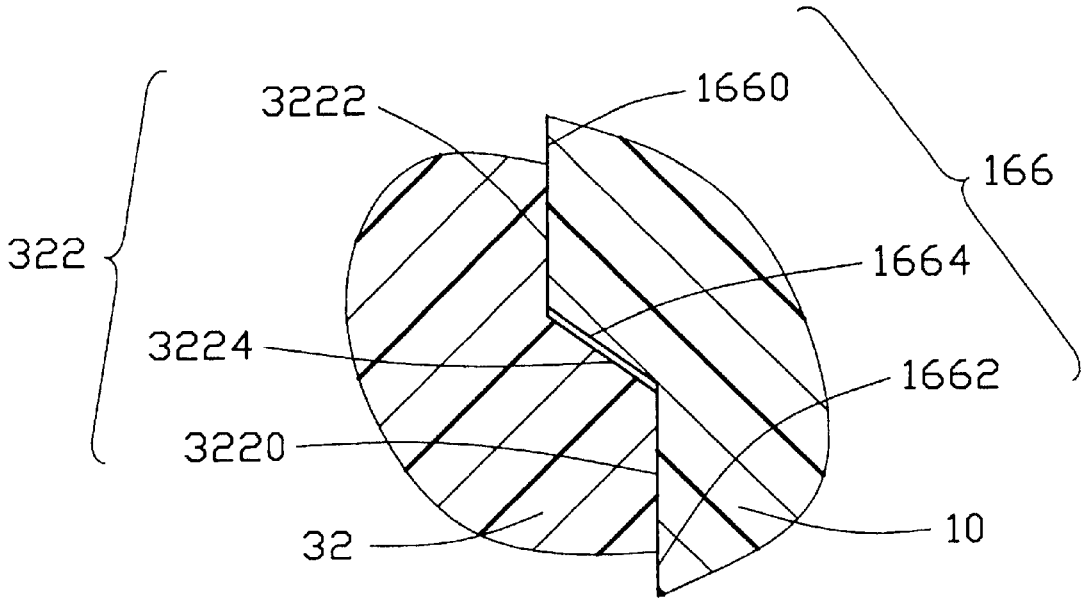
FIG. 5 is similar to FIG. 4 but the electrical socket is moved to a closed position.
Figure 6:
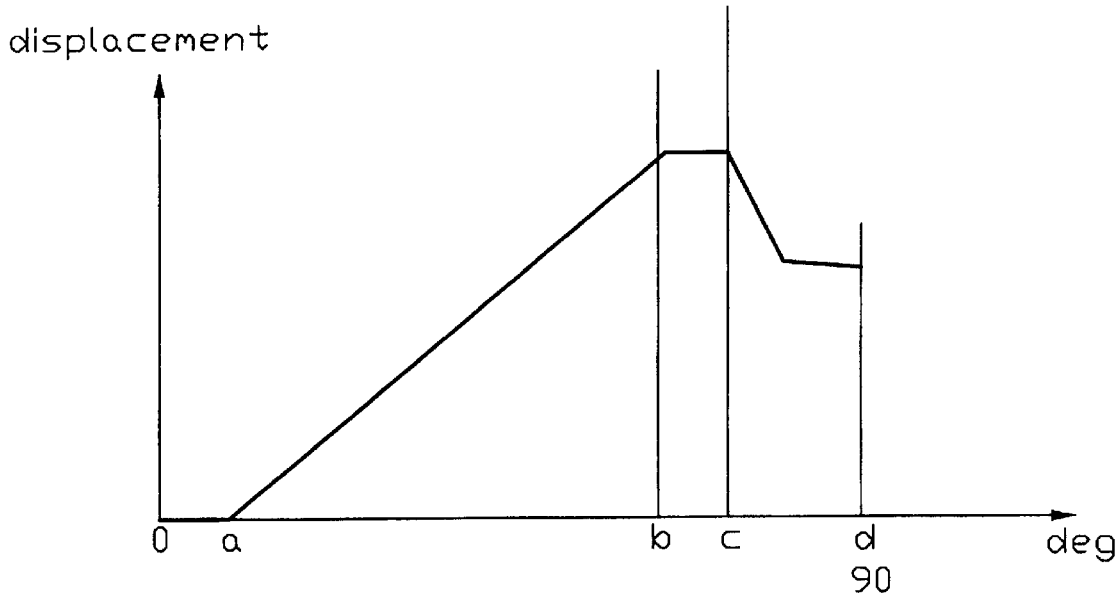
FIG. 6 is a diagram illustrating a relation between a displacement of a cover and a rotated angle of the actuation member of the electrical socket of the present invention, wherein the actuation member is rotated from zero degree (vertical orientation) to ninety degrees (horizontal orientation).

In use, referring to FIGS. 2 and 4 to 6 and cooperating FIG. 2, when the socket 1 is at an open position, in which the operating handle 34 of the actuation member 30 is in zero degree position and oriented vertically to the cover 20 and the base 10, the pin holes 22 of the cover 20 are vertically aligned with the terminal cells 12 of the base 10 such that the pins of the CPU package can be freely inserted through the pin holes 22 into the terminal cells 12. At this position, the displacement of the cover 20 relative to the base 10 is zero, and the upper portion 3220 of the contacting end 322 of the cam shaft 32 bears against the upper portion 1660 of the mating face 166. When the operating handle 34 of the actuation member 30 is rotated about 10 to 20 degrees from zero degree position to "a" degree position, the cover 20 is not pushed to move due to a clearance between the cam member 320 and the cover plate 40. Thus the displacement of the cover 20 is still zero. By further rotating the operating handle 34 of the actuation member 30 towards its horizontal direction, the cover 20 is thus pushed to move horizontally with respect to the base 10 along an "N" direction and the displacement of the cover increases gradually. The pins of the CPU package begin to move to mechanically and electrically connect with the conductive contacts 70 of the socket 1. The pushing force of the cam member 320 acting on the cover plate 40 (accordingly an induced stress of the cam member 320) increases following the increase of the displacement of the cover 20 during the rotation of the actuation member 30 from the position "a" to the position "b". When the operating handle 34 is rotated to "b" degree position, the stress arrives at a top peak and the displacement of the cover 20 attains a maximum at which the upper portion 3220 of the contacting end 322 of cam shaft 32 bears against the upper portion 1660 of the mating face 166, as shown in FIG. 4. When the operating handle 34 is further rotated about 10 degrees from "b" degree position to "c" degree position, the stress of the cam member 320 and the displacement of the cover 20 remain unchanged. During the process when the operating handle 34 is rotated from original position to "c" degree position, the upper portion 3220 of the contacting end 322 of the cam shaft 32 bears against the upper portion 1660 of the mating face 166 of the base 10 all the time. When the operating handle 34 is continually rotated from "c" degree position towards its horizontal direction, the upper portion 3220 of the contacting end 322 of the cam shaft 32 starts to slide on the slope portion 1664 of the mating face 166 of the base 10 slowly. The cam shaft 32 begins to move in a direction opposing to the "N" direction and the displacement of the cover 20 relative to the base 10 decreases gradually. The stress of the cam member 320 also reduces gradually. When the operating handle 34 is rotated to "d" degree position or ultimate position, that is, the socket is at a closed position, the contacting end 322 of the cam shaft 32 complementarily overlaps the mating face 166 of the receiving hole 164; in other words, the upper position 3220 of the contacting end 322 of the cam shaft 32 bears against the lower portion 1662 of the mating face 166 of the base 10, while the lower position 3222 of the contacting end 322 of the cam shaft 32 bears against the upper position 1660 of the mating face 166 of the base 10. The displacement of the cover 20 reduces distinctly compared with the displacement of the cover 20 at "c" degree position and the stress is released. At this situation, even if the socket is subject a high temperature environment, the cam member 320 does not have a problem of creep. Therefore, the CPU socket 1 ensures an effective and reliable connection between the pins of the CPU package and the conductive contacts 70 of the socket 1. Regarding the structure of the cover plate 40 and the cam member 320 and their interaction to move the cover 20 relative to the base 10, one can refer to U.S. Pat. No. 6,280,223 B1, which is assigned to the same assignee of the present application. Related disclosures of the '223 patent are incorporated herewith by reference.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical socket for supporting and electrically connecting an integrated circuit chip to a circuit board, comprising:

a dielectric base defining an array of terminal cells, a receiving space in one side of the base and a receiving hole communicating with said receiving space, said receiving hole having a step-shaped mating face, the mating face having an upper mating portion, a lower mating portion, and a slope mating portion connecting the upper mating portion and the lower mating portion;

a plurality of conductive contacts received in the terminal cells;

a cover slidably mounted on the dielectric base and defining an array of pin holes corresponding to the terminal cells for insertion of pins of the integrated circuit chip and an through aperture corresponding to said receiving space; and an actuation member received in the receiving space for moving the cover with respect to the dielectric base, the actuation member including a cam shaft, one end of said cam shaft mounted in said receiving hole, said one end having a step-shaped surface and forming an upper portion, a lower portion, and a slope portion connecting the upper portion to the lower portion wherein the surfaces of the upper and lower portions of said one end of the cain shaft perpendicular to an axis of the cam shaft;

wherein the upper portion of said one end of the cam shaft bears against the upper mating portion of the mating face of the receiving hole when said electrical socket is at an open position, while the upper portion and the lower portion of said one end of the cam shaft respectively bear against the lower mating portion and the upper mating portion of the mating face of the receiving hole when said electrical socket is at a closed position.

2. The electrical socket as claimed in claim 1, wherein the actuation member further includes an operation handle perpendicularly extending from the cam shaft that is rotatable with respect to the cam shaft.

3. The electrical socket as claimed in claim 2, wherein the cam shaft has a stepped shape and forms a cam member for moving the cover with respect to-the base.

4. The electrical socket as claimed in claim 2, wherein said receiving space includes a receiving chamber and a receiving slot communicated with the receiving chamber for receiving the cam shaft and the operating handle, respectively.

5. The electrical socket as claimed in claim 4, wherein the displacement of the cover is zero when the socket is at the open position, that is, the operating handle is in original position.

6. The electrical socket as claimed in claim 4, wherein a lateral side portion of the base defines an inclined face in one end of the receiving slot for preventing the actuation member over-rotating.

7. The electrical socket as claimed in claim 2, wherein a pair of stopping posts is further forced at opposite ends of a lateral side portion of the base and the operating handle defines a curved portion to latch with one of said posts of the base to stop the actuation member in the closed position.

* * * * *